US007819762B2

(12) United States Patent
Bernal-Silva et al.

(10) Patent No.: US 7,819,762 B2
(45) Date of Patent: Oct. 26, 2010

(54) GOLF TRAINING AID

(76) Inventors: Richard Anthony Bernal-Silva, 765 Mountain Ave., #274, Springfield, NJ (US) 07081; Janice Ann Lopez, 765 Mountain Ave., #274, Springfield, NJ (US) 07081

( * ) Notice: Subject to any disclaimer, the term of this patent is extended or adjusted under 35 U.S.C. 154(b) by 0 days.

(21) Appl. No.: 12/231,628

(22) Filed: Sep. 4, 2008

(65) Prior Publication Data

US 2009/0118030 A1 May 7, 2009

Related U.S. Application Data

(63) Continuation-in-part of application No. 11/903,286, filed on Sep. 21, 2007, now abandoned.

(51) Int. Cl.
*A63B 69/36* (2006.01)

(52) U.S. Cl. ..... 473/409; 473/280

(58) Field of Classification Search ..... 473/165, 473/280, 281, 351, 588, 589, 595, 409
See application file for complete search history.

(56) References Cited

U.S. PATENT DOCUMENTS

| | | | |
|---|---|---|---|
| 2,135,210 | A | 11/1938 | Farrar |
| 2,150,580 | A | 3/1939 | Crowley |
| 2,264,802 | A | 12/1941 | Kohl |
| 3,099,450 | A | 7/1963 | Randall |
| 3,166,327 | A | 1/1965 | Champion |
| 3,229,891 | A | 1/1966 | Edelman |
| 3,429,577 | A | 2/1969 | Godden |

(Continued)

OTHER PUBLICATIONS

PCT Int'l Search Report, Nov. 12, 2008, Donald Charles Michaels.

(Continued)

*Primary Examiner*—Nini Legesse
(74) *Attorney, Agent, or Firm*—Gearhart Law, LLC.

(57) ABSTRACT

A golfer training aid for use in teaching a golfer how to square up the face of the golf club at impact resulting in golf shots having substantial accuracy. The device is a one-piece or multi-piece flat-face practice golf ball. The one-piece or multi-piece practice golf ball is shaped with a flat face 2 on one side. (FIG. 1B). The flat face has a 90-degree or right angle cut 4 to the radial portion or circular embodiment 3 of the semi-sphere 1. The importance of this unique feature is that it enables the golfer to position the flat side of the club face with the flat face of the practice golf ball and contact the ball flush and correctly.

The flat face practice golf ball helps teach the golfer to hit a variety of controlled fades and a variety of controlled draws, a straight shot, as well as a backspin or descending blow, or a flop shot. These controlled shots are accomplished by rotating the practice ball's flat face to a desired angle and degree of openness depending on which direction the golfer chooses to target his or her golf shot. This flat face feature takes all the guesswork out of the mechanics of the golf swing by enabling the golfer to match the flat side of the club face with the flat face of the practice golf ball resulting in the golfer's ability to square up the face of the golf club at impact, regardless of his or her desired target.

7 Claims, 4 Drawing Sheets

U.S. PATENT DOCUMENTS

| | | | | | |
|---|---|---|---|---|---|
| 3,540,735 | A | * | 11/1970 | Miller | 473/267 |
| D220,769 | S | * | 5/1971 | LaHue | D21/709 |
| 3,796,435 | A | | 3/1974 | Dale | |
| 4,128,238 | A | * | 12/1978 | Newcomb et al. | 473/451 |
| 4,718,674 | A | | 1/1988 | Henry | |
| 4,925,192 | A | | 5/1990 | Forbes | |
| 5,042,815 | A | | 8/1991 | Sutton | |
| 5,139,263 | A | | 8/1992 | Feo | |
| 5,362,060 | A | | 11/1994 | Hinson | |
| 5,478,612 | A | * | 12/1995 | Hack et al. | 428/11 |
| 5,482,284 | A | | 1/1996 | Vandever | |
| 5,611,738 | A | | 3/1997 | Lundquist | |
| 6,089,989 | A | | 7/2000 | Sutcliffe | |
| 6,244,980 | B1 | | 6/2001 | Depcik | |
| 6,511,384 | B1 | | 1/2003 | Villacorta | |
| 2002/0039930 | A1 | | 4/2002 | Smith | |
| 2007/0093308 | A1 | * | 4/2007 | Rice | 473/157 |

OTHER PUBLICATIONS

PCT Written Opinion, Nov. 12, 2008, Donald Charles Michaels.
IB Patentability Report, Apr. 1, 2010, Bernal-Silva Richard Anth.

* cited by examiner

GOLF TRAINING AID

CROSS REFERENCE

This application is a continuation in part of U.S. patent application Ser. No. 11/903,286, filed on Sep. 21, 2007, the contents of which are incorporated herein by reference.

FIELD OF THE INVENTION

The present invention relates generally to a golf training aid and more particularly, the present invention relates to a golfer training aid for use in teaching a golfer how to square up the face of the golf club at impact resulting in golf shots having substantial accuracy.

BACKGROUND OF THE INVENTION

One of the greatest pleasures in golf is the sensation a golfer experiences at the instant he or she contacts the ball flush and correctly. Not even the best golfer can hit the ball this well on every shot because golf is a game of misses. Every golfer knows this and tries to build a swing that is fundamentally sound so that his or her "misses" are fairly well struck, accurate enough and playable on the golf course.

Golfers have high handicaps because they don't keep the golf ball in play. These problems are most often the result of the golfer's inability to keep the club moving at a right angle to the target line at impact, or "squared up" at impact. The ability of the golfer to square up the face of the club at impact escapes most amateur golfers. Because most amateur golfers do not properly square up the club, they are not able to achieve turning, or supination, of the arm and hand motion and contact the ball flush and correctly.

Some golfers buy expensive equipment to try and accomplish an accurate swing. The problem is, your clubs don't play golf—you do! This can result in golfers practicing the same bad habits over and over again that may take months to overcome. But it is working smart, not hard, that counts in practice time.

There are numerous golf training aids and devices that can be found in the prior art. Most of these training aids assist the golfer in proper alignment and ball position. Several early patents show the golfer how to properly align their stance through gauges, indicators, and alignment shafts. Representative of these devices are U.S. Pat. Nos. 2,150,580, 3,166,327, and 3,229,891. U.S. Pat. Nos. 4,718,674, 4,925,192, 5,042,815, and 5,362,060 are later devices that help teach the golfer how to properly align their body with a target and how to position a ball properly.

U.S. Pat. No. 3,429,577 relates to a golf training method whereas a pair of arcuate shaped members is to be placed on the ground with the golf ball placed in the center. Target members are included to help direct the club path. The golfer stands in line, open or closed to the target direction for hitting a golf ball straight, a fade, or a draw. While this device may be useful to some golfers, it lacks the ability to properly align the golfer's body or the ball position.

U.S. Pat. No. 5,139,263 shows a golf practice device in the form of a closed frame encircling an open area within which a golf ball may be positioned. Alignment elements are added to enable the golfer to hit straight, fade, and draw shots. While helpful to some, this device leaves the golfer with too much guesswork in positioning their body and in positioning the ball in relation to their forward heel.

U.S. Pat. No. 5,611,738 shows a golf swing alignment device for aligning a golfer's left foot and right foot with respect to an intended flight path of a golf ball. It consists of a flat main body having a ball placement calibration means for positioning the ball in the golfer's stance, oppositely located tapered ends defining a line collinear with the intended flight path, and calibrated left and right legs detachably mounted to the main body.

U.S. Pat. No. 6,089,989 shows golf instructional apparatus designed to teach a golfer to hit the ball straight and to correct the golfer's hook or slice. It's made up of a golf mat having a reference line. It also has a flexible cylinder located in a particular way so that on an improper swing, the golf club will hit it. It is also made up of flexible panels and a sensor.

The aforementioned patents are representative of numerous patents that relate to golf training devices. The prior art generally shows devices utilizing panels, strips, shafts, etc. to assist in the proper stance, proper alignment, and proper ball position for the golfer. The goal being that through repetition, the golfer will build a repeatable, reliable golf swing.

There are many elements that make up a good golf swing. Some being body alignment, ball position, swing plane and tempo. One of the most important elements, yet often overlooked is the gradual supination or turning sequence that occurs in the second part of the golf swing—from the start of the downswing to the finish of the follow-through. It is the most crucial part. This is the phase of the swing in which the player actually hits the ball.

The golfer's ability to hit the ball on the downswing and hit right on through the ball is essential to a good golf shot and dependent on several factors, most importantly the golfer's ability to ensure the left wrist and the back of the left hand begin to turn, or supinate, from a position where the palm is down to a position where the palm is up and to continue this turning motion through the rest of the swing.

In this sequence, there is one position of critical importance—the position of the left wrist and hand at the actual moment of impact. When this position is achieved in the swing sequence, the golfer is able to properly set the position of the club face, or square up the face of the golf club, when making contact with the ball that in turn supplies the loft, or how far and how high the ball will go. Ben Hogan in his classic book, Five Lessons—The Modern Fundamentals of Golf, said it best—"Every good golfer has his left wrist in this supinating position at impact. When the golfer is on this correct downswing plane, he has to hit from the inside out."

Most professional golfers agree that supinating sets up a number of extremely desirable actions. It helps the player to develop a properly wide forward arc. It puts the golfer in a position where his or her forearms are well extended at impact and will be fully extended just after impact as they swing outward toward his or her objective. The wider the arc, the more room the golfer has in which to build up clubhead speed, the prime factor behind distance.

From the discussion of the prior art, it is apparent that there exists a need to contain in one simple device, the training tools necessary to aid the amateur golfer as well as the expert golfer with the ability to develop and maintain a good golf swing. This training aid should be able to enable the golfer to obtain the correct downswing plane and supination of the wrist, and square up the face of the club at impact. It should be applicable to right-handed and left-handed golfers, the golfer should be able to use a variety of woods and irons with the device, it should be applicable for male and female golfers of any size or shape, it should be applicable to golfers of any age, and it should be able to teach the golfer not only how to hit a straight golf shot, but also how to hit a controlled fade in varying degrees and a controlled draw in varying degrees without changing their swing or grip.

SUMMARY OF THE INVENTION

The present invention is a golf training aid, comprising a semi-sphere having a radial portion and a flat face, the radial portion meeting the flat face at a continuous edge, with the radial portion having a maximum diameter of from about 3 cm to 6 cm, and the flat face having a diameter of from 3.5 cm to 5 cm.

Accordingly, the present invention provides a training system through which the golfer can develop a repeatable and consistent golf swing, supinating the wrist, to enable him or her to square up the face of the club at impact, and to enable a variety of different types of controlled golf shots without changing their swing or grip. The present invention accomplishes this goal through the following features.

The present invention provides for a one-piece or multi-piece flat-edge practice ball. The importance of this unique feature is that it enables the golfer to position the flat side of the club face with the flat side of the practice golf ball and contact the ball flush and correctly.

The present invention also provides a means for teaching the golfer to hit a variety of controlled fades and a variety of controlled draws as well as a straight shot. These controlled shots are accomplished by rotating the practice golf ball's flat-edge face to a desired degree of openness depending on which direction the golfer chooses to target his or her golf shot. This flat-face feature takes all the guesswork out of the mechanics of the golf swing by enabling the golfer to match the flat side of the club face with the flat side, or flat face, of the practice golf ball resulting in the golfer's ability to square up the face of the club at impact, regardless of his or her desired target. This feature also makes it easy for the golfer to quickly set up to and hit many flat-edge practice golf balls without the need to make any adjustments to the invention.

The present invention also provides that right-handed as well as left-handed golfers can use the invention. This is accomplished by setting the flat-edge ball on the ground, a golf mat, or a golf tee and positioning the flat side of the device facing toward the golfer's right side for right-handed golfers or facing toward the golfer's left side for left for left-handed golfers.

The present invention also provides that golfers of various ages, sizes, and shapes using a variety of clubs can use the invention.

These together with other objects, advantages, and applications of the present invention will become apparent to those skilled in the art when the following description is read in conjunction with the accompanying drawings.

DESCRIPTION OF THE PREFERRED EMBODIMENTS

Figure 1A:
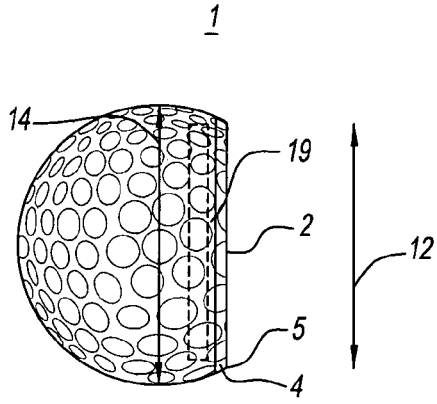
FIG. 1A is a side view of the invention.

The preferred embodiments of the present invention will now be described with reference to FIGS. 1A and 1B of the drawings. Identical elements in the various figures are identified with the same reference numerals.

The preferred embodiment of the invention is illustrated in FIG. 1A. A rear view of the flat-face surface is illustrated in FIG. 1B.

Figure 1B:
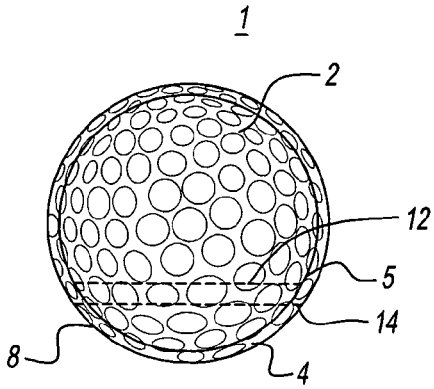
FIG. 1B is a rear view of the invention.
Figure 1C:
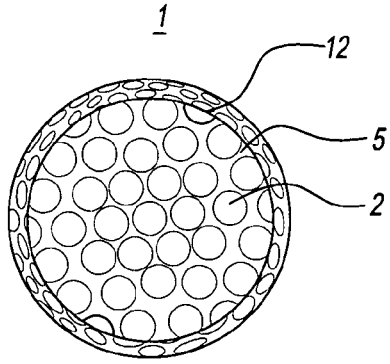
FIG. 1C is a front view of the invention.

FIG. 1 shows the semi-sphere 1, which has a radial portion (or circular embodiment) 3 with a radial portion diameter 14 and a radial portion surface 8 which may have a texture, such as dimpling. Semi-sphere 1 also has a flat face 2 with a flat face diameter 12. The flat face 2 is formed by making a right angle cut 4 on a sphere. The flat face 2 and radial portion 3 share a continuous edge 5. The continuous edge 5 is essential to the invention because it provides a consistent flight trajectory and roll. The main variable influencing the semi-sphere's trajectory is the user's swing. In particular, it is believed that edge protrusions or other irregularities, such as found in some prior art, may cause the semi-sphere to project in an inconsistent manner, even for identical user swings. The continuous edge 5 is also more effective in reducing the influence of the flat face when the semi-sphere rolls after it lands, thereby providing more accurate data to the user about his or her golf swing.

FIG. 1B shows a rear view of the invention. The flat face 2 of semi-sphere 1 is shown. FIG. 1B illustrates the continuous edge 5, the right angle cut 4, the flat face diameter 12 and the radial portion diameter 14. The radial portion surface 8 is also shown in FIG. 1B.

The one-piece or multi-piece practice ball is shaped with a flat face 2. The flat face 2 has a 90-degree or right angle cut 4 to the radial portion 3. of the semi-sphere 1. The flat face 2 may be the same weight as the radial portion 3 of the semi sphere 1, or it may include a counterweight.

The optional counterweight functions to stabilize the ball when it's oriented so the radial portion may rest on the ground, and the flat face may be orientated in any position without tipping over. The counterweight may be formed from a material that is heavier than the radial portion 3 of the semi-sphere 1, such as any of the materials listed below, but is preferably made from a dense heavy material such as steel. The counter weight can be any suitable weight or size, and it's function is to help stabilize the semi sphere when placed in position for training. A preferred embodiment of the counterweight is a coin-shaped counterweight, placed so the flat face of the coin-shaped counterweight is in parallel orientation to the flat face of the semi-sphere. For maximum effect, the counter weight should be in proximity to the semi-sphere and offset the weight displaced by the missing part of the ball. The counterweight may or may not add to the overall weight of the semi-sphere.

The present invention provides for an embodiment that may be used indoors or outdoors and whose components may be formed of any material, including but not limited to, plastics, thermoplastics, rubbers, thermoplastic elastomers, metals, fabrics, wood or wood products, paper or paper products, resins, enamels, composites, or any combination of these materials or any other materials which become available in the future, including. Particularly preferred are any materials deemed suitable or acceptable by the USGA guidelines. The semi-sphere 1 may be hollow or solid. It may weigh from 7 to 45 grams, with a preferred weight of 40 grams.

The relative proportions of the flat face 2 to the radial portion may be such that the radial portion 3 comprises a ¾ sphere. The semi-sphere can be any sphere greater than ½ a sphere, preferably at least a ⅔ sphere. In a preferred embodiment, the flat face diameter 12 is approximately 3.7 cm, and the radial portion diameter 14 is approximately 4.2 cm, but the flat face diameter 12 and the radial portion diameter may range in size from 0.5 cm to 50 cm, and their sizes in relation to each other may be similar as in the preferred embodiment described above or may vary.

The flat-face practice golf ball comprises a surface appearance that may be white or any color and may include a satisfactory adhesion of a clear or colored coat of a chemical composition on to the radial portion surface 8 (FIG. 1B) of the semi-sphere 1.

The embodiment may be formed by and its exterior design may include a smooth or textured radial portion surface 8 to give the appearance of a real golf ball. This allows the golfer to have the experience of visualizing an actual USGA golf ball when engaged in practice drills with the flat-face practice golf ball. Alternately, the radial portion surface 8 of the semi-sphere 1 may have any texture, including but not limited to, dimpled, rough, elastic, or any texture desired for different uses.

The flat-face golf practice ball is intended for use indoors or outdoors. The ball may be placed directly on the ground, on the grass, on the sand, on an artificial turf mat, or any other hard or semi-soft surface suitable for ball striking. Also, the ball may be used with a golf tee for ball striking. While the invention can be used with any wood or iron or striking implement, the operation described herein describes its use with a mid-range iron.

Since either right-handed or left-handed golfers can use this invention, the description for operation will be described for each separately.

Figure 2A:
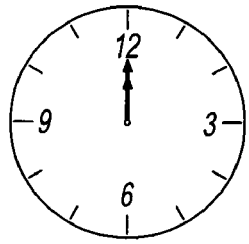
FIG. 2A is a schematic view of a golf club positioned against the flat face of the ball with respect to the desired target line. Shown in this figure is a clock dial with hour and minute handle indicating 12 o'clock. The dashed line indicates the position of the golfer. The ball is shown with flat face facing 6 o'clock so that the opposite round side or radial portion is facing 12 o'clock. a club is facing the flat face of the ball.
Figure 2A:
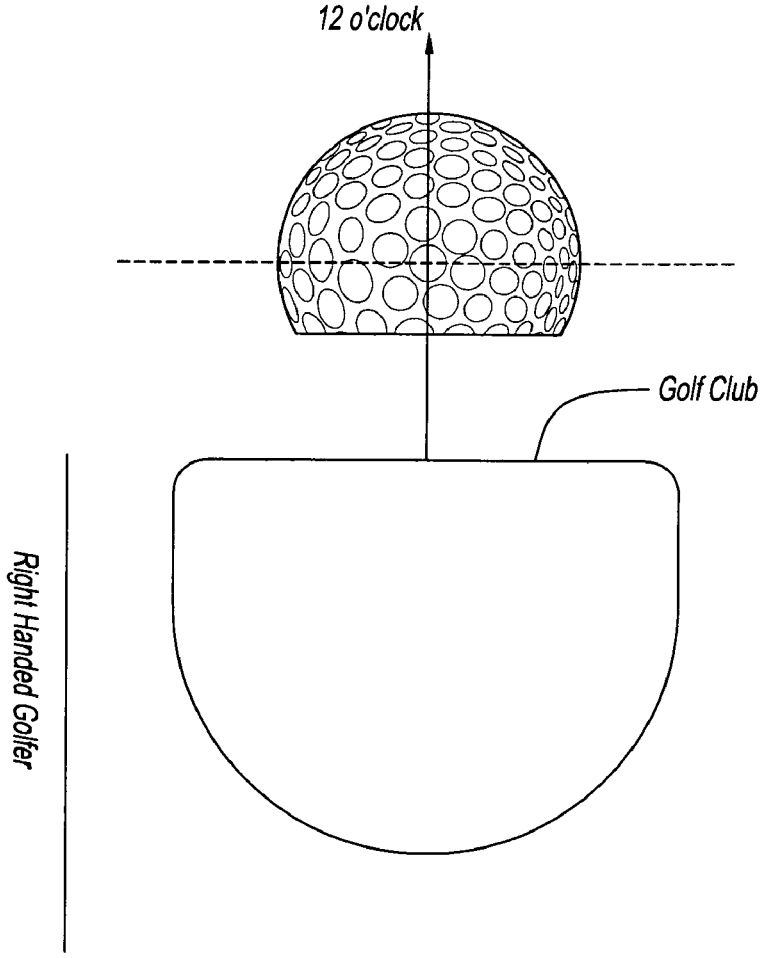

The right-handed golfer:

To set up the ball with a mid-range iron, picture a clock on the ground with the face of the clock pointing toward the sky. Imagine the number 12 is facing the target line, or aimed in the desired direction the golfer wishes to hit the ball. Standing at 9 o'clock, place the flat face of the ball facing 6 o'clock so that the opposite round side or radial portion is facing 12 o'clock (as shown in FIG. 2A). This position sets up the flat face of the ball with the club face for ball striking for a right-handed golfer.

Figure 2B:
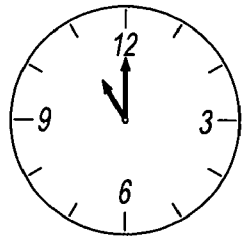
FIG. 2B is a schematic view of a golf club positioned against the flat face of the ball with respect to the desired target line. Shown in this figure is practice of a straight or slight draw position, with the round side or radial portion of the ball facing towards the angle position of 1 o'clock, with the flat face at a 90-degree angle to the striking surface.
Figure 2B:
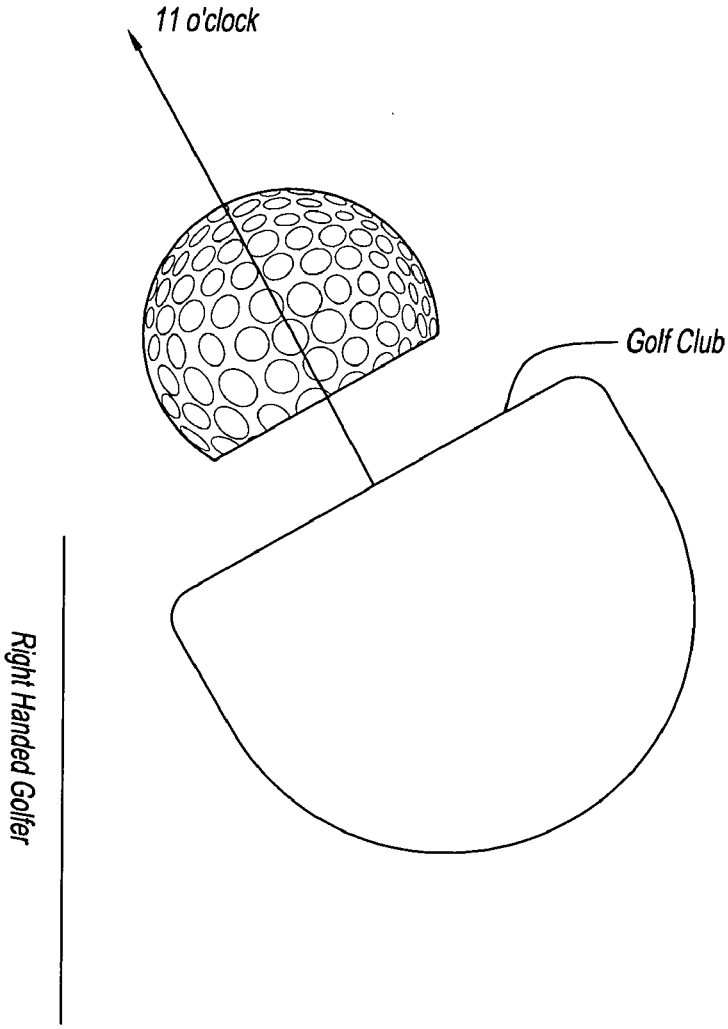
Figure 2C:
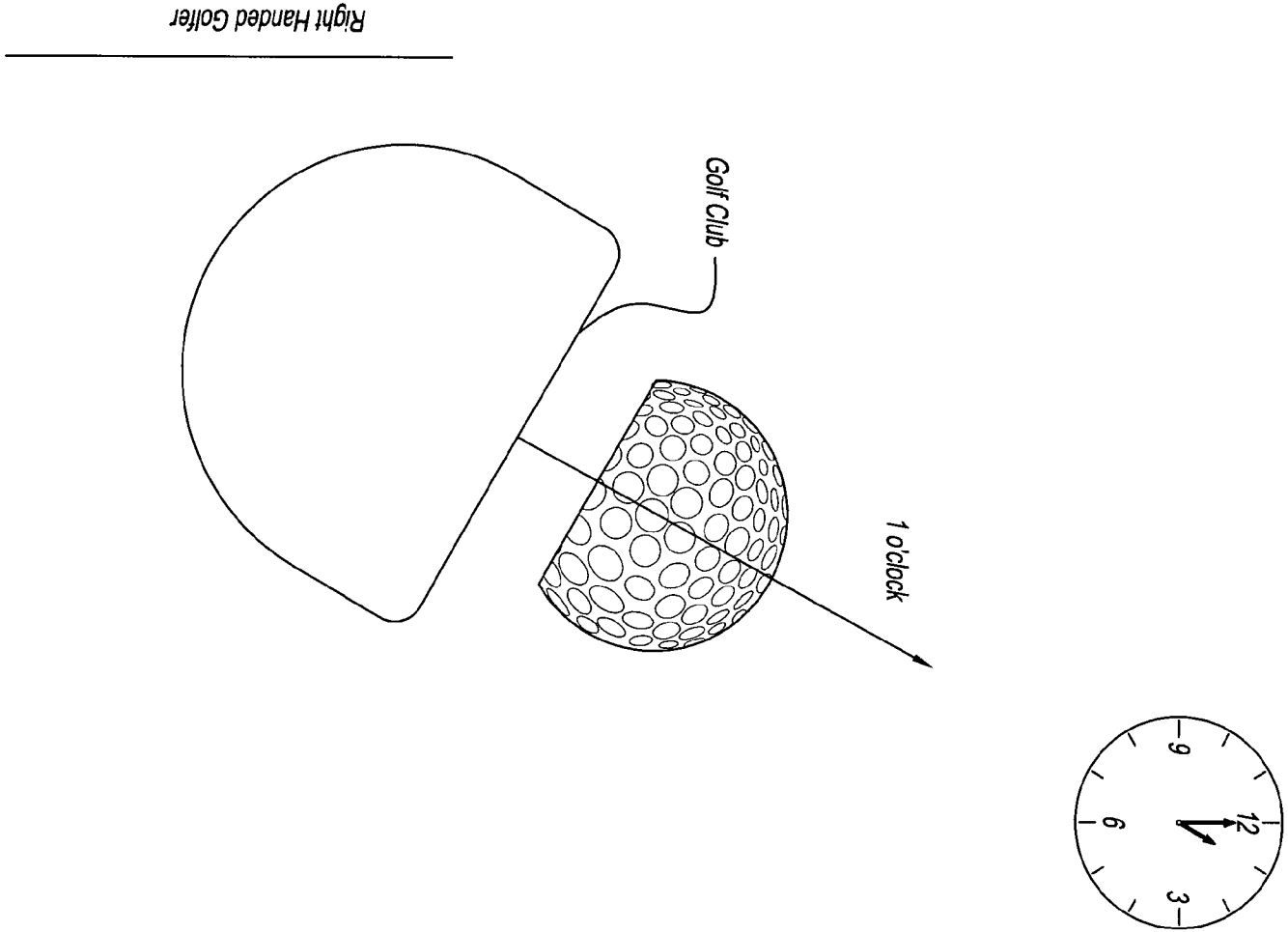
FIG. 2C is a schematic view of a golf club positioned against the flat face of the ball with respect to the desired target line. Shown in this figure is a fade practice position, with the round side or radial portion of the ball facing towards the angle position of 11 o'clock, with the flat face at a 90-degree angle to the striking surface.

To practice a straight or slight draw, position the round side or radial portion of the ball facing towards the angle position of 1 o'clock, with the flat face at a 90-degree angle to the striking surface (as shown in FIG. 2C). Proceed by hitting the flat face of the ball with the leading edge of the club.

To practice a fade, position the round side or radial portion of the ball facing towards the angle position of 11 o'clock, with the flat face at a 90-degree angle to the striking surface (as shown in FIG. 2B). Proceed by hitting the flat face of the ball with the open face of the club.

To practice a backspin or descending blow, position the flat face of the ball facing slightly upward towards the sky, increasing the angle to greater than 90 degrees to the striking surface.

To practice a flop shot, position the flat face of the ball facing slightly downward towards the ground, decreasing the angle to less than 90 degrees to the striking surface.

The left-handed golfer:

To set up the ball with a mid-range iron, picture a clock on the ground with the face of the clock pointing toward the sky. Imagine the number 12 is facing the target line, or aimed in the desired direction the golfer wishes to hit the ball. Standing at 3 o'clock, place the flat face of the ball facing 6 o'clock so that the opposite round side or radial portion is facing 12 o'clock. This position sets up the flat face of the ball with the club face for ball striking for a left-handed golfer.

To practice a straight or slight draw, position the round side or radial portion of the ball facing towards the angle position of 11 o'clock, with the flat face at a 90-degree angle to the striking surface. Proceed by hitting the flat face of the ball with the leading edge of the club.

To practice a fade, position the round side or radial portion of the ball facing towards the angle position of 1 o'clock, with the flat face at a 90-degree angle to the striking surface. Proceed by hitting the flat face of the ball with the open face of the club.

To practice a backspin or descending blow, position the flat face of the ball facing slightly upward towards the sky, increasing the angle to greater than 90 degrees to the striking surface.

To practice a flop shot, position the flat face of the ball facing slightly downward towards the ground, decreasing the angle to less than 90 degrees to the striking surface.

Although the description above contains many specificities, these should not be construed as limiting the scope of the invention but as merely providing illustrations of some of the presently preferred embodiments of this invention. For instance, the invention may be used with other types of spherical sports implements where a training aid is desired, such as but not limited to, tennis, baseball, croquet or polo.

Thus the scope of the invention should be determined by the appended claims and their legal equivalents, rather than by the example given.

We claim:

1. A method of enabling a user to obtain a correct downswing plane and supination of the user's wrist during, comprising the steps of:

placing a one piece semi-sphere ball on the ground, golf mat or tee, the semi-sphere ball having a radial portion and a flat face;

orienting the flat face of the semi-sphere ball in a manner that the flat face of a golf club will make contact with the flat face of the semi-sphere ball, when the golf club is swung by the user, allowing the user to swing the club; the user matching the flat face of the golf club with the flat face of the semi-sphere ball at impact, so that the semi-sphere has a trajectory as fade, draw or straight shot; wherein, the radial portion of the semi-sphere meets the flat face of the semi-sphere at a continuous edge;

the radial portion has a maximum diameter of from about 3 to 6 cm; and the flat face of the semi-sphere has a diameter of from about 2.5 to 5.0 cm.

2. The method of claim 1, wherein the semi-sphere ball is set for a right handed golfer.

3. The method of claim 1, wherein the semi-sphere ball is set for a left handed golfer.

4. The method of claim 1, wherein the semi-sphere ball is set for a straight shot.

5. The method of claim 1, wherein the semi-sphere ball is set for a fade shot.

6. The method of claim 1, wherein the semi-sphere ball is set for a draw shot.

7. The method of claim 1, wherein the semi-sphere ball is set for a shot having backspin.

* * * * *